US007292195B2

(12) United States Patent
Phillips et al.

(10) Patent No.: US 7,292,195 B2
(45) Date of Patent: Nov. 6, 2007

(54) ENERGY DIVERSITY ANTENNA AND SYSTEM

(75) Inventors: James P. Phillips, Lake In The Hills, IL (US); Andrew A. Efanov, Crystal Lake, IL (US); Kristen M. Leininger, Grayslake, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/189,689

(22) Filed: Jul. 26, 2005

(65) Prior Publication Data

US 2007/0024514 A1 Feb. 1, 2007

(51) Int. Cl.
*H01Q 11/12* (2006.01)

(52) U.S. Cl. ..... 343/744

(58) Field of Classification Search ..... 343/741–744
See application file for complete search history.

(56) References Cited

U.S. PATENT DOCUMENTS

| | | | | |
|---|---|---|---|---|
| 2,372,651 | A * | 4/1945 | Capen et al. | 343/743 |
| 4,611,212 | A | 9/1986 | Lee | |
| 4,633,519 | A | 12/1986 | Gotoh et al. | |
| 5,392,054 | A | 2/1995 | Bottomley et al. | |
| 5,760,747 | A | 6/1998 | McCoy et al. | |
| 5,784,032 | A | 7/1998 | Johnston et al. | |
| 5,977,916 | A | 11/1999 | Vannatta et al. | |
| 6,104,356 | A | 8/2000 | Hikuma et al. | |
| 6,175,334 | B1 | 1/2001 | Vannatta et al. | |
| 2002/0190908 | A1 | 12/2002 | Andrews et al. | |

FOREIGN PATENT DOCUMENTS

EP 0 108 816 A1 10/1982

OTHER PUBLICATIONS

W.C.Y. Lee, "Statistical Analysis of the Level Crossing and Duration of Fades of the Signal from an Energy Density Mobile Radio Antenna", Bell System Technical Journal, vol. 46, Feb. 1967, pp. 416-440.

W.C.Y. Lee, "An Energy Density Antenna Model for Independent Measurement of the Electric and Magnetic Fields", Bell System Technical Journal, vol. 46, Sep. 1967, pp. 1587-1599.

W.C.Y. Lee, Mobile Communications Engineering, McGraw—Hill Book Company, New York, 1982, pp. 159-163.

K. Fujimoto and J. R. James, Editors, Mobile Antenna Systems Handbook, Artech House, Boston, 1994, p. 85.

K. Fujimoto and J. R. James, Editors, Mobile Antenna Systems Handbook Second Edition, Artech House, Boston, 2001, pp. 407-417.

* cited by examiner

*Primary Examiner*—Michael C. Wimer
(74) *Attorney, Agent, or Firm*—Lawrence J. Chapa

(57) ABSTRACT

An energy density diversity antenna (EDA) has a least a pair of antenna elements, whose feeding points are connected to outputs of a hybrid coupler configured such that a sum and a difference signal may exist at the feed points of the antenna elements. First reactive elements are respectively inserted in the antenna elements proximal the respective feed points. The antenna elements are joined at a point distal from the feed points by a second reactive element, and a third reactive element is coupled between feed lines coupled to the feed points at a location between the feed points and the outputs of the hybrid coupler.

23 Claims, 10 Drawing Sheets

ENERGY DIVERSITY ANTENNA AND SYSTEM

TECHNICAL FIELD

This application relate to antenna systems and more specifically to antenna systems of the type which may include an energy diversity antenna.

BACKGROUND

Antennas have been devised for use with mobile or portable communications devices, including cellular telephones. Various antenna types are used, including monopole, dipole, loop and patch antennas. Each antenna has particular advantages and drawbacks which are considered by designers when choosing an antenna for a specific application.

When used for receiving purposes, antennas may operate in the presence of multi-path signals, and with signal wavefronts of arbitrary polarization with respect to a characteristic polarization of an antenna element. The received signal amplitude for each antenna element is thus often characterized by a time-dependent property associated with a changing multi-path environment or with the motion of the receiver, which may lead to reception difficulties if the received signal becomes too weak.

Generally, the received signals may be characterized as having a spatially and temporally varying field strength comprised of an E-field (electrical field) and an H-field (magnetic field). Various antenna configurations may be considered to optimize the received signal strength, including diversity configurations, such as space diversity, polarization diversity and pattern diversity.

In many applications, the size of the antennas is small and each of the antennas may not be optimized for the frequency being used, leading to further losses in received signal strength. This may also reduce the power which may be effectively transmitted.

DESCRIPTION

Exemplary embodiments may be better understood with reference to the drawings, but these embodiments are not intended to be of a limiting nature. Like numbered elements in the same or different drawings perform equivalent functions.

An antenna assembly is described, including a conductive circuit formed in the approximate shape of a loop and disposed in proximity to a counterpoise. A first feed point and a second feed point at each end of the conductive circuit each connect to an output of a hybrid coupler having a sum input and a difference input. The antenna is tuned in a sum frequency mode by a first impedance inserted in series with the loop at each of the first and second feed points, and the antenna is tuned in a difference frequency mode by an impedance inserted in series with the loop at a location substantially equidistant from the first and the second feed points. The first impedance may also serve to match the impedance of the antenna with respect to the sum and difference inputs of the hybrid. A third impedance may be connected between the first and second feed points to match the impedance of the antenna with respect to the difference input of the hybrid.

The antenna may be used in a diversity communications system, where each of the sum and difference inputs of the antenna is connected to a receiver channel and the demodulator output of the received channel corresponding to the maximum received signal strength is selected or combined.

Figure 1:
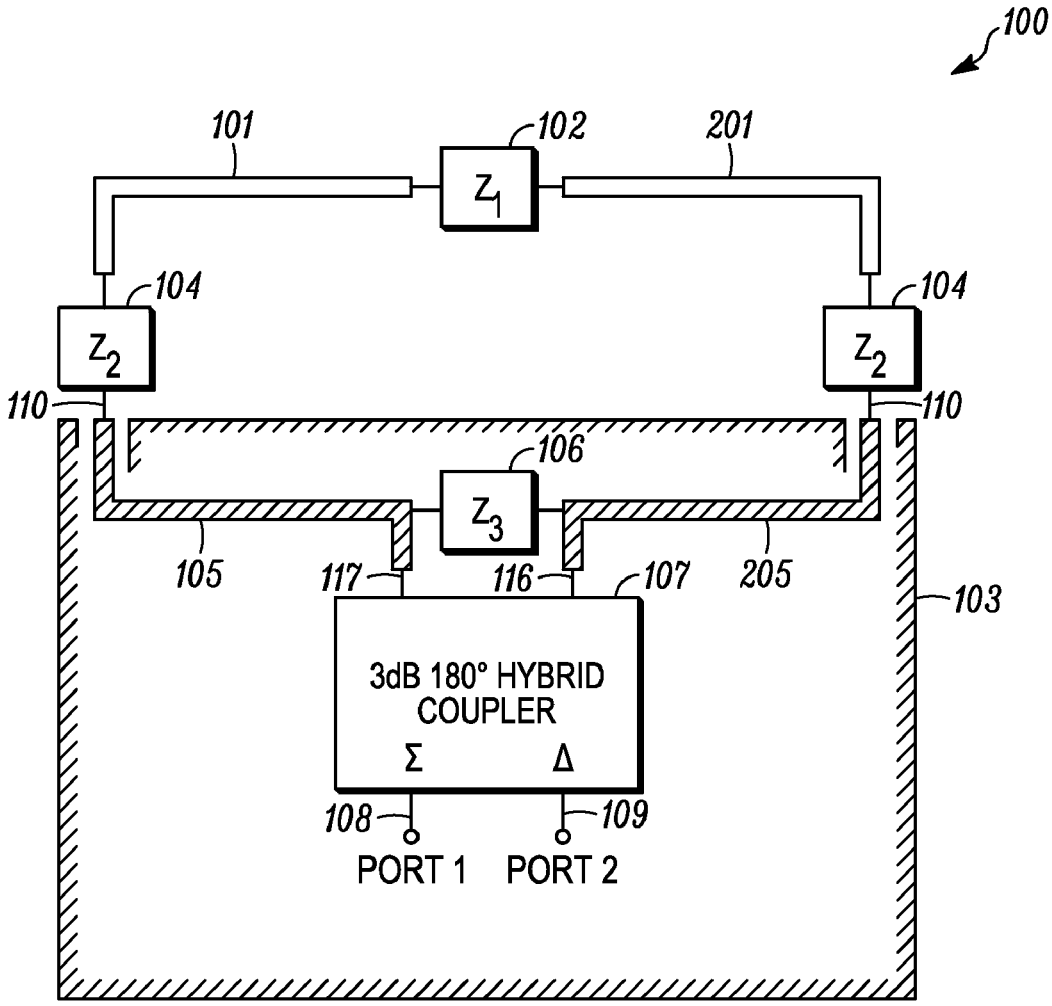
FIG. 1 shows a loop antenna having sum and difference feed modes using a 3-dB 180 degree hybrid coupler.

FIG. 1 illustrates an example of an energy diversity antenna 100. The antenna comprises two electrical conductors 101, 201, which in accordance with at least some embodiments are substantially symmetrical. While in at least one embodiment, the antenna branches would be symmetrical, routing through an existing housing, as well as around other components, may result in antenna branches, which are less than symmetrical. Depending on the size and use of the antenna, the electrical conductor elements may be formed from one or more metals, such as: copper, aluminum, or the like, which can be deposited on or contained in a dielectric substrate; metal tubes, rods or sheets or similar self-supporting structures; or wires supported by a dielectric structure.

The conductors 101, 201 may be electrically connected so as to cooperate with an electrical image created by a conductive counterpoise 103, or a replica of the conductors substantially symmetrically disposed so as to create a physical image antenna. In the example shown in FIG. 1, where the conductors 101, 201 are disposed with respect to a counterpoise 103, each conductor 101, 201 is in the approximate shape of an "L", and the combination of the elements 101, 201 may be described as an "inverted-U" when viewed with respect to the counterpoise 103. The two conductors 101, 201 are connected to a transmission line 105, 205 at the end of the respective conductor 101, 201 proximal to the counterpoise 103.

The type of the antenna 100 may variously be described as a monopole or a loop, depending on the method of feeding the antenna elements (for example, sum or difference feed modes). These terms of description of antenna types, when used to describe the shape of the antenna conductors, are meant to be interpreted broadly with respect to physical form and may comprise polygonal, rectangular, circular or elliptical outlines or other approximations thereto, as is known in the antenna art. The "inverted-U" 101, 201 may have the appearance of a loop with feed point 110 proximal to the counterpoise 103. It will be recognized by persons skilled in the art that, as described herein, the antenna shape may be described broadly as a loop or loop antenna, although the radiation pattern of the antenna may be either approximately described as that corresponding to a monopole or a loop, depending on the current distribution in the conductors. The context in which the term is utilized will determine the meaning thereof.

Each of the transmission lines 105, 205, in at least some embodiments will be of approximate equal lengths and connect to the output ports of a 3-dB 180-degree hybrid coupler 107. A hybrid coupler is a means of feeding an antenna in either a sum mode or a difference mode corresponding to a configuration of the input ports of the coupler. The impedance of the transmission line 105, 205 may be 50 Ohms, and the transmission line 105, 205 may be of an unbalanced configuration, such as a coaxial cable or microstrip transmission line. The hybrid coupler 107 is configured so as to have two input ports: a sum port 108 and a difference port 109, and two output ports 116 and 117.

Antenna characteristics may be considered from either a transmitting or a receiving perspective by application of the principle of electromagnetic reciprocity, as is known in the art, and the perspective used may depend on achieving simplicity of description, with the understanding that an equivalent showing may be made by invoking the principle of reciprocity.

Considered from a transmitting perspective, a signal applied to the sum input port 108 of the hybrid coupler 107 causes the two conductors 101, 201 to be driven at the feed points 110 in an in-phase manner, and thus the currents in each of the vertical portions of the L flow in the same direction, and the currents in the top horizontal portions of the L flow in opposite directions. As a practical matter, the currents opposing each other in the top horizontal portions approximately cancel, and the currents in the vertical portions of the elements, in conjunction with the image created by the counterpoise 103, contribute to a vertical radiated field.

When a signal is applied to the difference port 109 of the hybrid coupler 107, the two conductive elements 101, 201 elements are driven at the feed points 110 in an out-of-phase manner. That is, the current in one of the vertical portions of one conductive element 101 is substantially equal in magnitude and opposite in the phase to the current in a vertical portion of the other conductive element 201, and the current in the top horizontal portions of elements 101, 102 flows in the same direction. In this situation, the currents in the vertical portions of the L approximately cancel, and the currents in the horizontal top portion of the L, in conjunction with the image created by the counterpoise 103, contribute to a horizontal magnetic radiated field.

It will be appreciated that a physical antenna may be utilized in place of the counterpoise with similar effect. A "counterpoise" may also be termed a "ground plane", although in some antenna arrangements, the counterpoise may not have the characteristics of an ideal ground plane. Such ideal characteristics may be expressed as being of infinite apparent electrical length and conductivity and being orthogonal to, for example, a vertical monopole. The non-ideal operation of a counterpoise may be evaluated by theoretical or numerical analysis depending on the individual circumstances.

In addition to radiation patterns which may be computed for the antenna 100 when fed by the output ports 116, 117 of the hybrid coupler 107, the efficiency of the antenna is related to the impedance matching of the signal source to the antenna.

Impedance matching, used as a general term, represents the desirability of adjusting the electrical properties of the antenna, as seen from the signal source, such that the impedance of the antenna at the signal source terminals is equal to the complex conjugate of the signal source impedance. This optimizes the signal energy transfer between an antenna and a signal generator. In many instances, the signal source impedance is resistive, and is equal to the transmission line impedance. Thus more optimal coupling of energy may occur when the antenna is configured to have a resistance, which is as close to or equal to the transmission line impedance. When the antenna is not resonant at the signal frequency, the antenna impedance is neither purely resistive, nor equal to the transmission line impedance. Impedance matching at a signal frequency may comprise adjusting one or both of the value of the antenna real and imaginary impedance values as measured at the input to the antenna system, to achieve more optimal power transfer. It is recognized that such matching may be more optimal at only one signal frequency, and that imperfect matching may occur as the frequency varies from the signal frequency at which the matching has been achieved.

Impedance matching, or tuning, of an antenna with fixed dimensions is performed with impedance elements such as inductors and capacitors, which may be in lumped constant or distributed form. Generally, the modification of the antenna characteristics by insertion of reactance elements such as inductors and capacitors results in a modification of the current distribution on the antenna elements. That is, the impedance matching of the sum operating mode and the difference feeding modes may interact with each other.

As shown in FIG. 1, a configuration exists where the impedance matching of the sum mode and the impedance matching of the difference mode do not substantially interact. In the sum mode, both conductive elements 101, 201 are being driven at respective feed points 110 with signals of generally the same phase and magnitude from the output ports 116, 117 of the hybrid coupler 107. A reactive element 104, having a reactance value Z2 is connected between each antenna element 101, 201 and the feeding transmission line 105, 205 at the respective feeding points 110 as a way of resonating the loop at a frequency in the sum mode and matching the impedance with respect to the sum mode feed point. The reactance value Z2 of the reactive element 104 is dependent on the dimensions of the conductive elements 101, 201, the counterpoise 103, which may be a chassis, and the signal frequency. The reactive element 104 is disposed at each feed point 110 and generally has substantially the same value in each conductive element 101, 201. The value Z2 of the reactive element 104 is selected to tune the conductive elements 101, 201 to a resonance at the signal frequency, and may also provide a good match to the impedance of the transmission lines 105, 205. Depending on the impedance values required, the reactive elements 104 may be largely either inductive or capacitive.

As a means for resonating the antenna at a frequency in the difference feed mode, a reactive element 102, having a reactance value Z1, is connected between the top ends of the conductive elements 101, 201. As previously discussed, in the sum feed mode, the net current is approximately zero at this substantially symmetrical point between the two feed points 110, and the reactance element 102 has minimal theoretical effect on the current flow in the antenna in the sum feed mode. In at least some embodiments, the substantially symmetrical point between the two feed points 110 is substantially equidistant. In some of these instances, a point substantially equidistant can result in distances between reactance element 102 and the respective feed points 110, which vary as much as ten percent. Any variation in the distances between reactance element 102 and respective feed points 110 can sometimes be at least partially accommodated by differences in the physical properties and/or characteristics of each of the conductive elements 101, 201.

However, a net current flow through the reactance element 102 when the antenna is fed in the difference mode by the hybrid coupler 107, and the reactance value Z1 of the reactance element 102 may be selected to tune the antenna to resonance at a signal frequency as a loop. As the impedance 102 has minimal effect on the tuning of the monopole (sum) mode, the signal frequencies at resonance of the loop and the monopole may be made different. For simplicity in discussion, but without loss of generality, the monopole resonance frequency and the loop resonance frequency are made the same in this example.

The reactance value Z1 of the reactance element 102 used to tune the antenna 100 in the loop feed mode depends on the dimensions of the antenna structure, and the value Z2 of the reactance elements 104 used to tune the monopole mode of operation to achieve impedance matching in the corresponding sum feed mode. Depending on a required value Z1 of the reactance element 102, the reactive element 102 may be largely either inductive or capacitive. Although the antenna may be tuned to resonance in the loop feed mode by the reactance element 102, the impedance of the antenna in the difference (loop) mode may not be equal to that of the feeding transmission lines 105, 205. A reactive element 106, having a reactance value Z3, may be connected between the center conductors of the transmission lines 105, 205 for purposes of impedance matching the difference mode with respect to the different feed points. Reactive element 106 generally does not affect the current flowing in the sum (monopole) mode as the magnitude and phase of the current flowing in each of the antenna conductive elements 101, 201 and the transmission line 105, 205 is substantially equal at corresponding and/or generally symmetrical points with respect to the feed points 110, and there is therefore minimal, if any, theoretical voltage difference between the terminals of the reactance element 106 in the sum feed mode. However, the currents in the difference (loop) feed mode are out of phase at the location of the reactance element 106, and the reactance element 106 may be used to match the impedance of the antenna elements 101, 201 to the transmission line 105, 205 in the difference mode of operation. The actual value Z3 of the reactance element 106 is dependent on the input impedance of the conductive elements 101, 201 at the feed point 110 at resonance in the difference mode of operation, the lengths of the transmission lines 105, 205 between the feed points 110 and the value Z1 of the reactance element 102, and on the signal frequency. Depending on the reactance value Z3 required, the reactive element 106 may be largely either an inductor or a capacitor, and the elements thereof may be either lumped constants or distributed.

Figure 2:
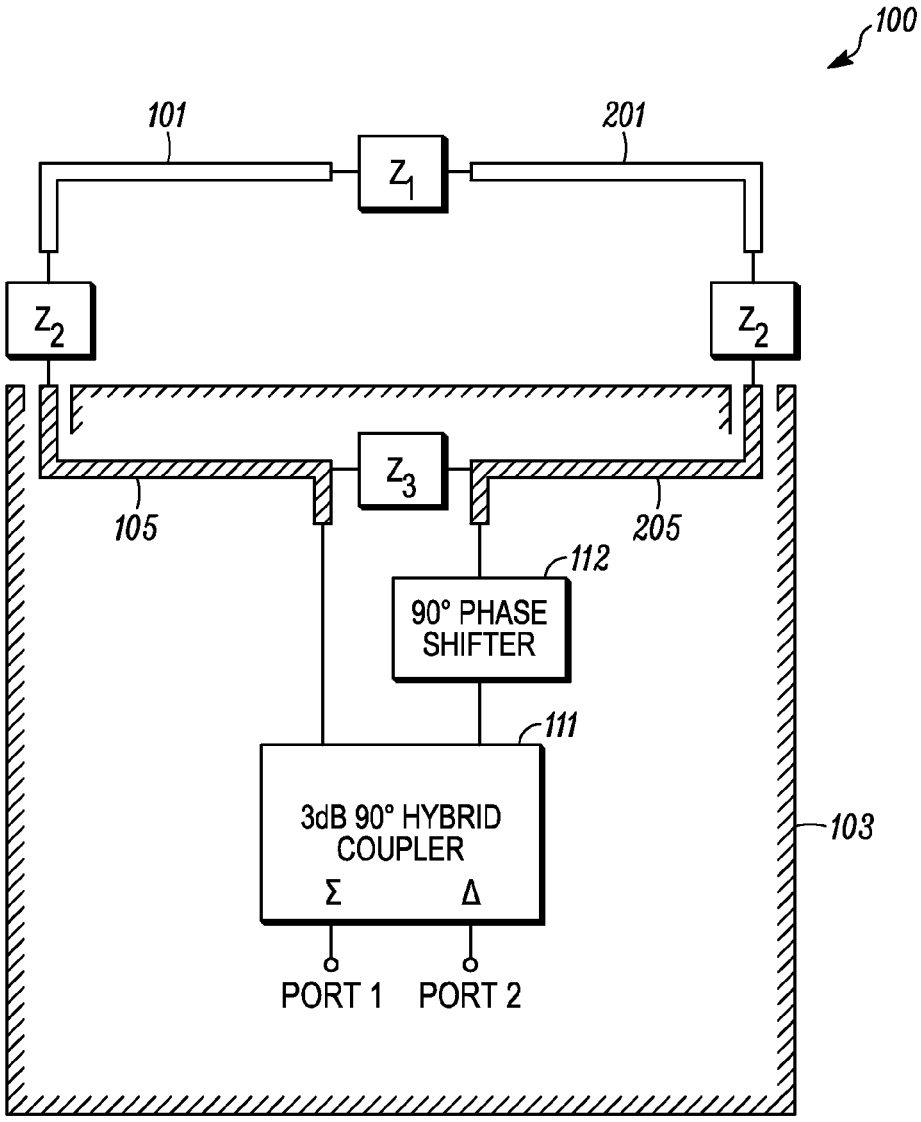
FIG. 2 shows a loop antenna having sum and difference feed modes using a 90 degree hybrid coupler and a 90 degree phase shifter.

In another aspect, the 3-dB 180 degree hybrid coupler 107 shown in FIG. 1 can be replaced with a 3-dB 90 degree hybrid coupler 111 and a 90-degree phase shifter 112, shown in FIG. 2. One skilled in the art will recognize that further variations in the implementation of a hybrid coupler 107 are additionally possible without departing from the teachings of the present invention.

The radiation patterns of the monopole and the loop antennas formed using the sum and difference input ports 108, 109 of the hybrid coupler are approximately given by the theoretical radiation patterns of a monopole and a loop over a ground plane, respectively. In an actual design, the radiation patterns will differ from the ideal situation, and the expected radiation patterns may be computed by numerical analysis methods.

Figure 3:
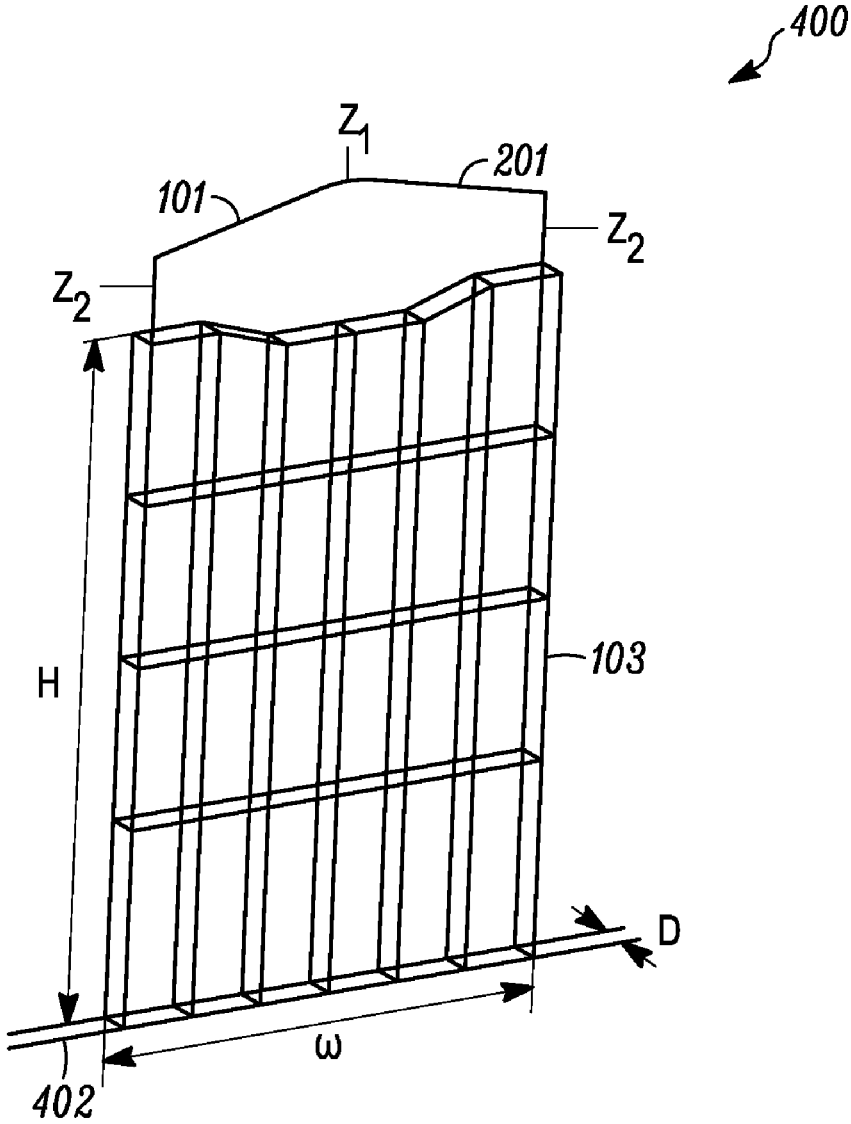
FIG. 3 shows a wire model of the antenna and counterpoise as used in a numerical analysis of the antenna radiation pattern characteristics.

The AOP (Antenna Optimizer Professional) program from Brian Beezley, (3532 Linda Vista, San Marcos, Calif. 92069) was used to model the configuration shown in FIG. 3, where the major dimensions are:

Counterpoise (103): 54 mm wide (W) by 84 mm high (H) by 4 mm thick, having a grid spacing of 10 mm in the width direction and 20 mm in the height (H) direction; wire diameter, 3 mm;

Conductive antenna elements (sum of lengths of antenna elements 101, 201): 50 mm wide by 9 mm high with varying diameters ranging from 1 mm dia. in the center to 4 mm dia. at the ends;

Center Reactive Element (102): 45 nHy (Z1);

End Reactive Element (104): 4 nHy (Z2);

Extensions (402) to model computer body: 43 mm long by 3 mm in diameter; and Signal Frequency 2048 MHz.

The wire model of FIG. 3 represents an antenna of the type shown in FIG. 1 with a counterpoise which may be the body of a data card 400, such as a PCMCIA (Personal Computer Memory Card International Association) data card, to be plugged into a computer port. A computer chassis is simulated by the horizontal extensions 402 from the data card model at the end opposite to that of the antenna 101, 201. Similar results may be expected for an antenna in a cellular telephone, where the data card may represent a cellular telephone, personal digital assistant (PDA) or radio telephone chassis, and the computer chassis may not be present.

When approximate symmetry of the components is maintained, the values of the reactive elements 102, 104 and 106 do not have a significant effect on the radiation pattern shape, but they may affect the amplitude response due to impedance mismatch.

Figure 4A:
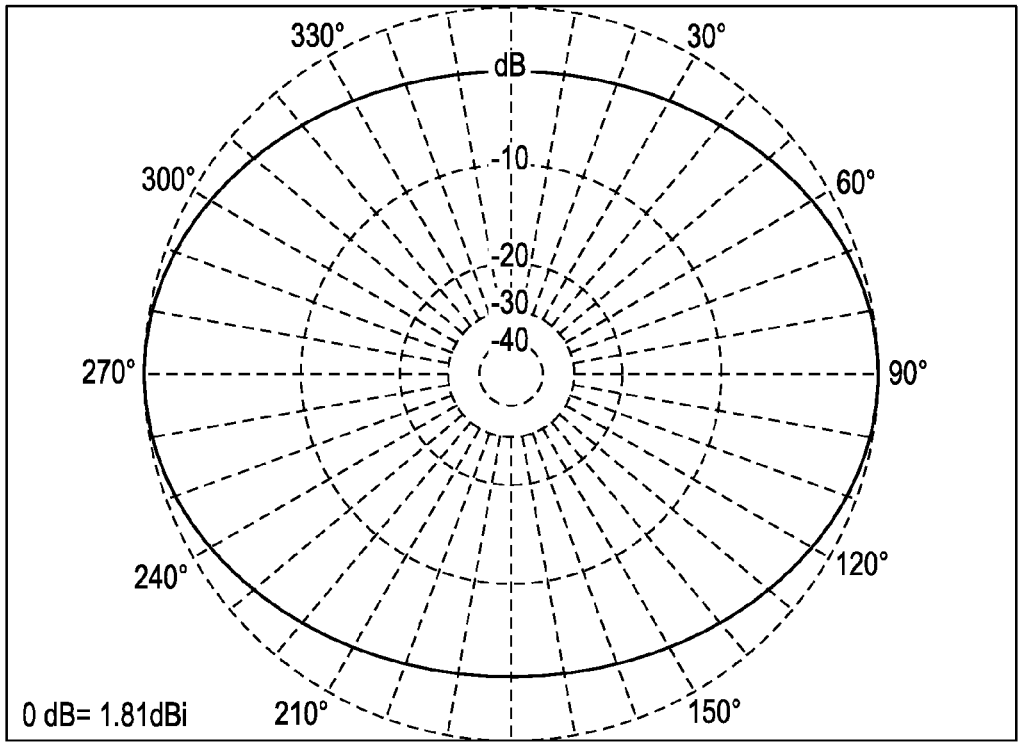
FIG. 4 depicts the results of the numerical analysis of the azimuth plane radiation patterns in the sum (A) and the difference (B) feed modes.
Figure 4B:
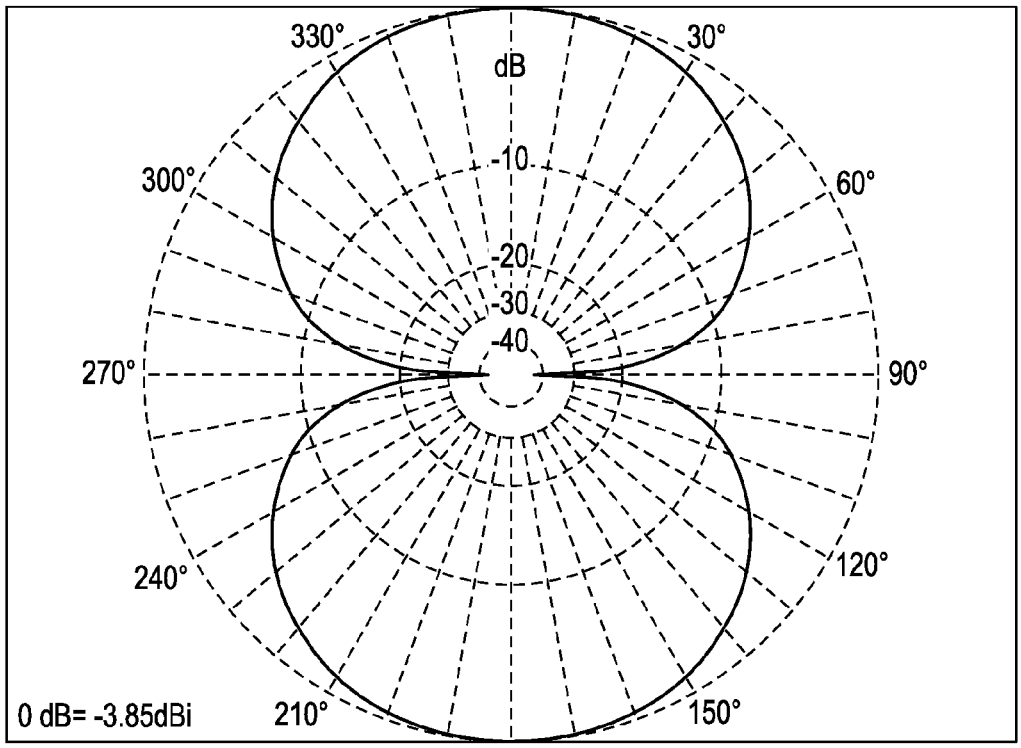

FIGS. 4A and 4B illustrate the azimuth radiation patterns in the sum mode (FIG. 4A) and in the difference mode (FIG. 4B). The radiation in FIG. 4A has a similarity to the expected radiation pattern from a monopole disposed above a ground plane although there are distortions, particularly at the 0 degree and 180 degree azimuths, which may be associated with the ground plane configuration. Similarly, the radiation pattern in FIG. 4B has a similarity to the expected radiation pattern from a loop antenna.

Figure 5A:
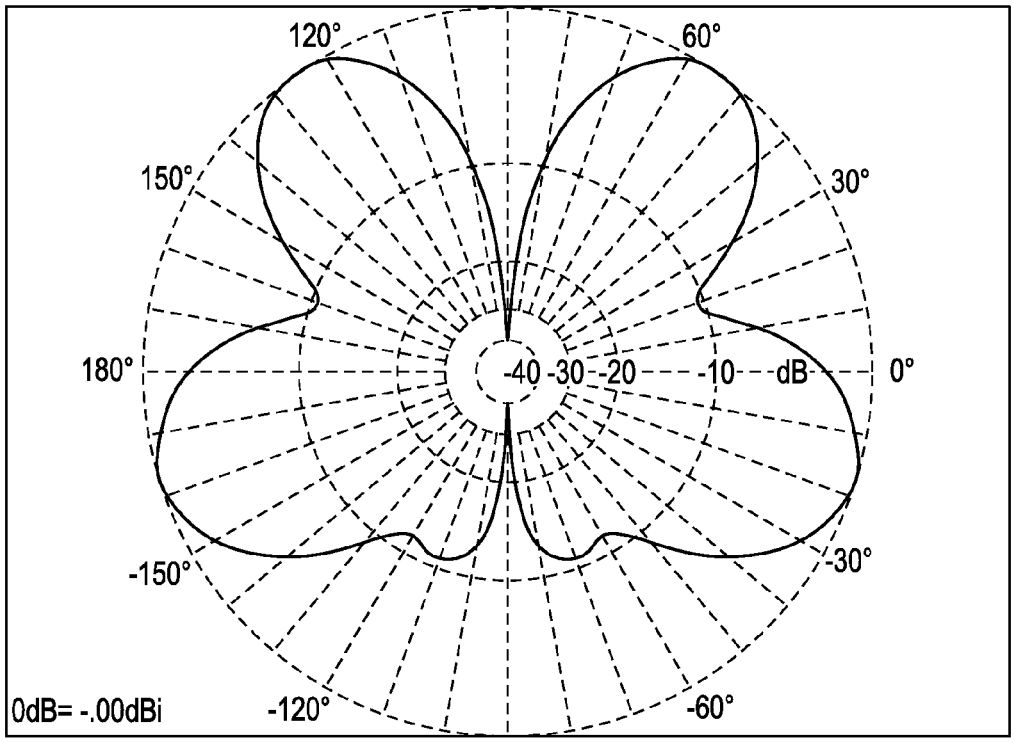
FIG. 5 depicts the results of the numerical analysis of the elevation plane radiation patterns in the sum (A) and the difference (B) feed modes.
Figure 5B:
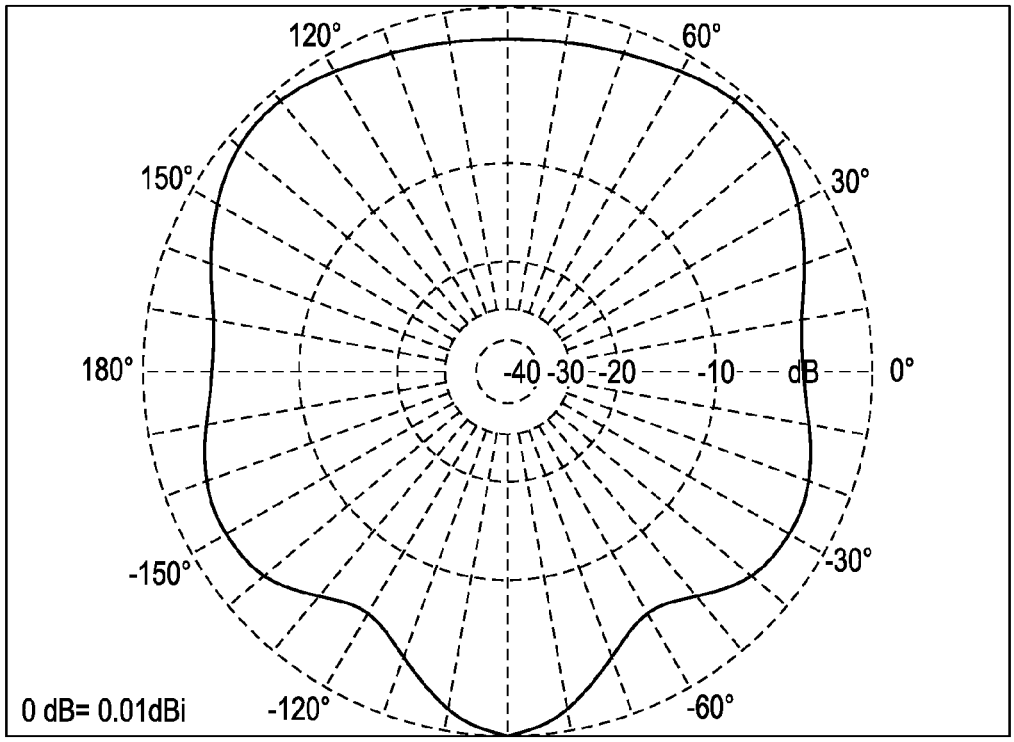

FIGS. 5A and 5B illustrate the elevation plane radiation patterns at the azimuth of peak azimuth radiation. In FIG. 5A, the sum mode exhibits a pattern which has similarities to the elevation plane pattern of a monopole antenna, particularly the null at 90 degrees elevation. However, a response below the horizontal (negative elevation angles) is observed, and is attributed to the effects of the ground plane. FIG. 5B illustrates the difference mode elevation pattern in the plane of maximum azimuth radiation. Here a relatively uniform response is observed, but with some non-symmetrical effects in the elevation plane which may be due to the ground plane.

Comparison of the azimuth plane patterns of the sum mode and the difference mode (FIGS. 4A and 4B) indicates that the azimuth radiation patterns of the sum and the difference antennas tend to be complimentary. That is, when the antenna response of one of the feed modes (either the sum feed mode or the difference feed mode) is high in a direction, the other mode tends to have a low response in the same direction. Comparison of the elevation plane patterns of the sum and the difference modes (FIGS. SA and 5B) indicates that the elevation plane patterns of the sum and the difference modes tend to be complimentary. Due to the principle of reciprocity, the transmitting and receiving antenna pattern shapes are generally the same.

Figure 6:
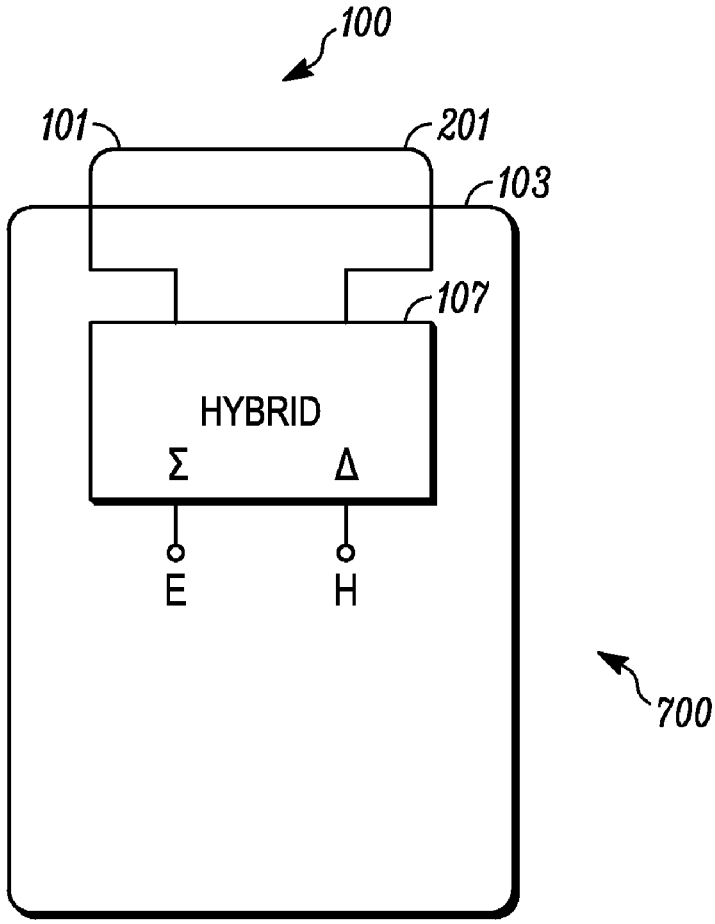
FIG. 6 shows a loop antenna attached to the body of a cellular telephone.
Figure 7:
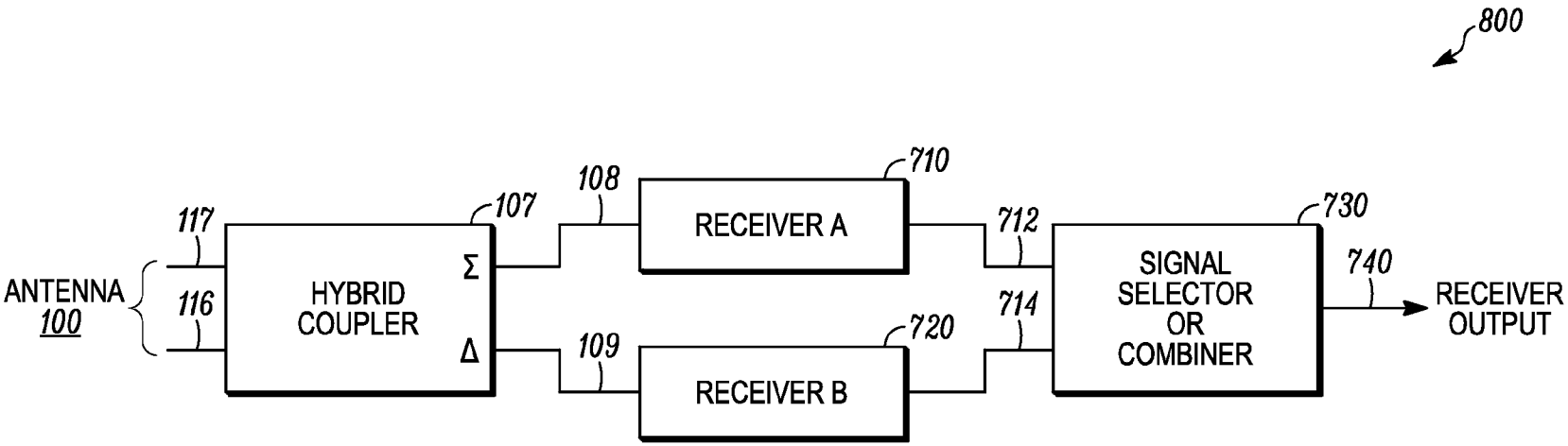
FIG. 7 shows a diversity receiver connected to the sum and difference inputs of a hybrid coupler.

An antenna as in FIG. 1 having a sum and a difference pattern as in FIGS. 4 and 5 may be used as a component of a transmitting and receiving system such as a cellular telephone. FIG. 6 shows a physical arrangement of the antenna 100 with respect to the remainder of the cellular telephone body 700. The sum and difference ports may each be connected to a diversity receiver. A number of diversity receiver configurations are known, and an example is shown in FIG. 7 where the sum and difference antenna ports are connected to a first receiver 710 and a second receiver 720, respectively. The signals received by the sum feed mode and difference feed mode hybrid ports 108, 109 are each processed by a channel of the receiver 800 so as to demodulate the information being transmitted on the carrier wave. At the output of the demodulators 712, 714 one of the demodulated signals is selected by a signal selector or combiner 730 to be output 740 for further processing. The basis of the selection may be the signal strength of each of the two antenna-feed mode outputs, so that the demodulated output selected has the highest strength, which may be correlated with a higher signal-to-noise ratio and a lower error rate.

Figure 9:
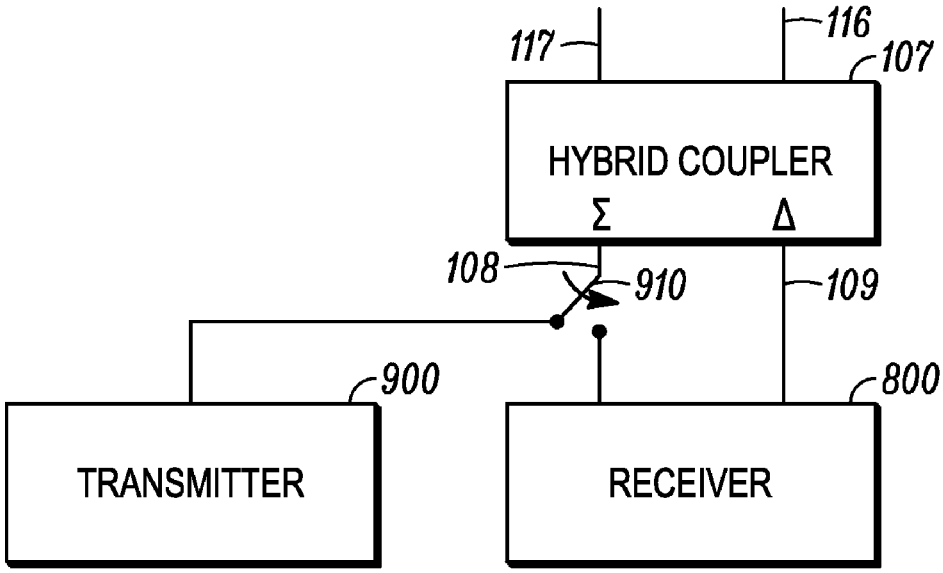
FIG. 9 shows a portion of a radiotelephone having a diversity receiver and a transmitter connectable to a hybrid coupler.

In a further example shown in FIG. 9, the transmitting and receiving system may use either of the sum 108 or difference 109 inputs of hybrid 107 for transmitting purposes. In FIG. 9, the connection of the transmitter 900 to the sum port 108 of the hybrid 107 is shown, resulting in transmitting on the monopole feed mode. The sum input 108 is switched between the transmitter 900 and the receiver 800 by switch 910. Alternatively the transmitter 900 may be connected to the difference port 109 by a switch similar to switch 910, or be capable of being switched to either the sum port or the difference port.

In another aspect, the antennas may be used for transmitting, either as two simultaneous transmitting antennas, or one of the antennas may be used. The azimuth radiation pattern of the difference antenna may be oriented so as to direct a larger percentage of the electromagnetic energy in a more preferred direction.

Figure 8A:
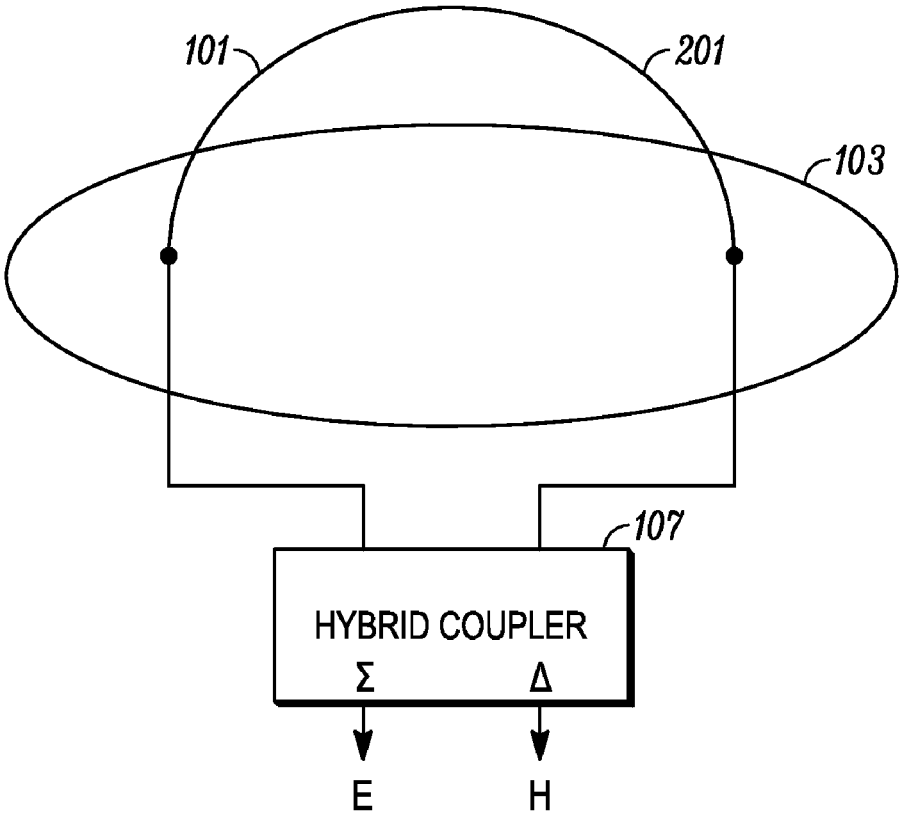
FIG. 8 shows a (A) single loop antenna, and (B) two loop antennas substantially orthogonally disposed.
Figure 8B:
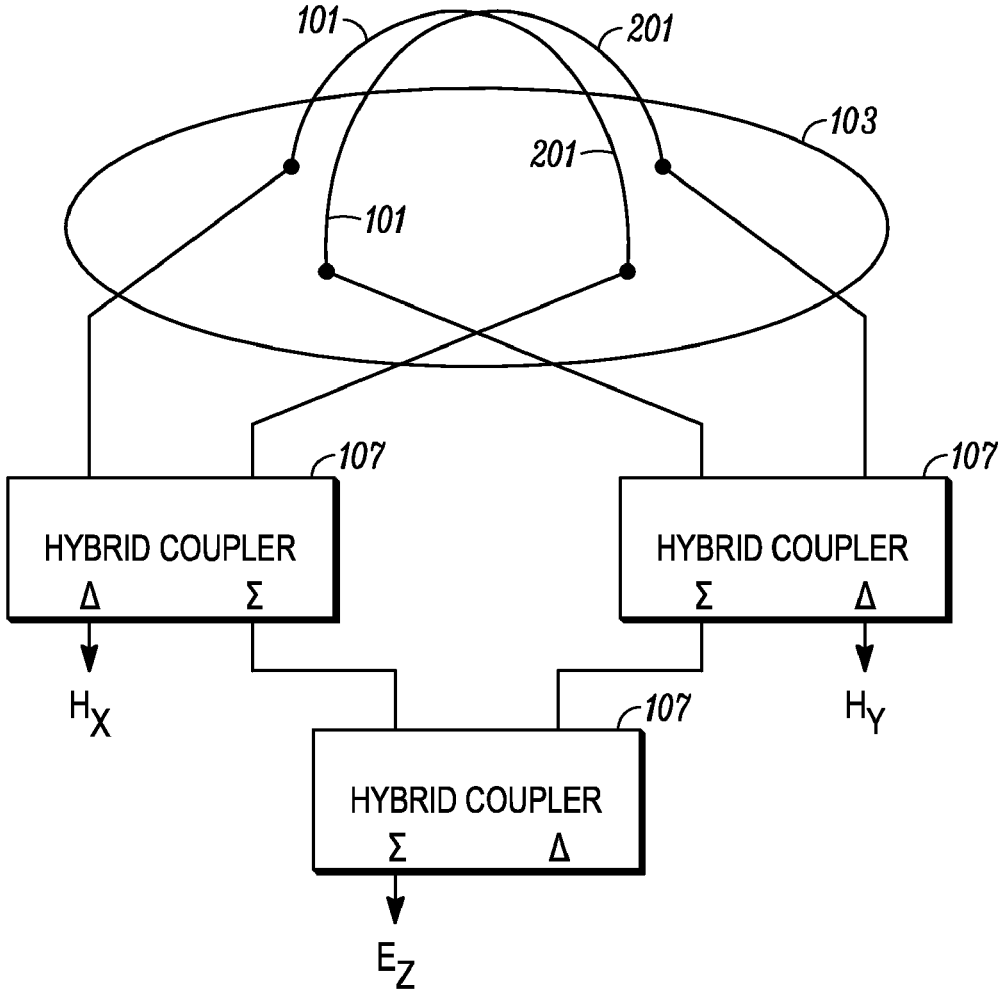

In another example, two antennas as shown in FIG. 8B may be disposed with respect to a ground plane 103 such that the planes of the antennas are mutually orthogonal. This may be compared with the example of FIG. 8A, which corresponds to the antenna of FIG. 1. Each of the antennas in FIG. 8B operates as previously described, however the difference in antenna patterns produced by hybrid couplers 107 denoted as outputs Hx and Hy, have azimuthal radiation patterns shifted by 90 degrees, and are substantially orthogonal to each other. The antenna patterns of the sum ports of the two antennas are generally more symmetrical, however, any aximuthal effect will tend to be mutually orthogonal. A sum hybrid 107 may be used to combine the individual sum outputs of individual antenna hybrid couplers 107 to form a sum output Ez. Each of the signals Hx, Hy and Ez may be processed in a multi-channel diversity receiver as previously described.

In yet another aspect, the counterpoise may be omitted and loop or inverted-U shaped elements disposed such that it is substantially symmetrical with respect to the first antenna. The antennas are disposed such that the feed points are adjoining. In this manner, the second antenna can be used to enhance the symmetry of the configuration similar to a ground plane. The two orthogonal antennas may not have the same dimensions. The antennas may be joined at the feed points and the reactance Z2 may be disposed in each of the antennas, or a reactance Z2 may be disposed between the joined antennas and the feed point. Reactance Z1, Z2 and Z3 are determined according to the methods previously discussed, for each of the antennas.

Although the present invention has been explained byway of the examples described above, it should be understood to the ordinary skilled person in the art that the invention is not limited to the examples, but rather that various changes or modifications thereof are possible without departing from the spirit of the invention. Accordingly, the scope of the invention shall be determined by the appended claims and their equivalents.

What is claimed is:

1. An antenna assembly comprising:

a loop comprising a conductive circuit;

a counterpoise;

a first feed point and a second feed point at each end of the conductive circuit, each feed point communicating with an output of a hybrid coupler having a sum input and a difference input;

a first impedance inserted in series with the loop at each of the first and the second feed point; and a second impedance inserted in series with the loop at a location substantially equidistant from the first and second feed points; and wherein the conductive circuit includes a plurality of separate segments along a length of the conductive circuit, where two or more of the segments substantially extend in a first direction and at least one of the segments substantially extends in a second direction that is substantially orthogonal to the first direction, and where each one of the two or more of the segments that substantially extend in the first direction is respectively associated with and located proximate a corresponding one of the first and second feed points, and one of the at least one of the segments that substantially extends in a second direction includes or is proximate the location along the loop that is substantially equidistant from the first and second feed points.

2. The antenna assembly of claim 1, wherein a loop shape is an inverted "U".

3. The antenna assembly of claim 1, wherein the first and the second feed points communicate with the output of the hybrid coupler by a first and a second microstrip transmission line, and a third impedance is connected between a center conductor of the first microstrip transmission line and a center conductor of the second microstrip transmission line.

4. The antenna assembly of claim 1, wherein the first impedance has a value such that a resonance of the loop in communication with the sum input occurs at a first predetermined operating frequency.

5. The antenna assembly of claim 4, wherein the first impedance has a value such that an impedance match to a transmission line connected at the first and the second feed points.

6. The antenna assembly of claim 1, wherein the second impedance has a value such that a resonance of the loop in communication with the difference input occurs at a second predetermined operating frequency.

7. The antenna assembly of claim 1, wherein the value of first impedance and the value of the second impedance are selected such that a first resonance of the loop in communication with the sum input and a second resonance of the antenna in communication with the difference input are at a same frequency.

8. The antenna assembly of claim 7, further comprising a third impedance connected between the first and second feed points, wherein the third impedance has a value such that an impedance match of the loop in communication with the difference input is at the same frequency.

9. The antenna assembly of claim 1, wherein the loop is a conductive trace or a wire disposed on a printed circuit board.

10. The antenna assembly of claim 1, wherein the loop is a self-supporting structure.

11. The antenna assembly of claim 1, wherein the counterpoise is a cellular telephone chassis, and a plane of the loop and a plane of the cellular telephone chassis are substantially coplanar.

12. The antenna assembly of claim 1, wherein a plane of the counterpoise and a plane of the loop are substantially orthogonal.

13. The antenna assembly of claim 1, wherein the counterpoise is the body of a wireless communication device including at least one of a computer, a personal digital assistant (PDA), a PCMCIA card, or a cellular telephone.

14. The antenna assembly of claim 1, wherein the hybrid coupler is a 180 degree hybrid coupler.

15. The antenna assembly of claim 1, wherein the hybrid coupler is a 90 degree hybrid coupler and a 90 degree phase shifting network in series with the output of the 90 degree hybrid coupler.

16. The antenna assembly of claim 15, wherein the phase shifting network in series with the 90 degree hybrid coupler output has a differential phase shift of 90 degrees.

17. The antenna assembly of claim 1 further comprising:

a second loop comprising a conductive circuit;

a third feed point and a fourth feed point at each end of the second conductive circuit, each of the third and fourth feed point being connected to an output of a second hybrid coupler, the second hybrid coupler having a sum input and a difference input;

a third impedance inserted in series with the conductive circuit at each of the third and the fourth feed point; and a fourth impedance inserted in series with the conductive circuit at a location substantially equidistant from the third and fourth feed points.

18. The diversity antenna of claim 17, wherein the sum input of the first hybrid coupler and the sum input of the second hybrid coupler are connected to outputs of a third hybrid coupler.

19. A radiotelephone comprising:

a radio transmitter;

a radio receiver;

an antenna assembly electrically coupled with the radio transmitter and the radio receiver, further comprising:

a loop comprising a conductive circuit;

a counterpoise;

a first feed point and a second feed point at each end of the conductive circuit, each feed point connected to an output of a hybrid coupler having a sum input and a difference input;

a first impedance inserted in series with the loop at each of the first and the second feed point; and a second impedance inserted in series with the loop at a location substantially equidistant from the first and second feed points; and wherein the conductive circuit includes a plurality of separate segments along a length of the conductive circuit, where two or more of the segments substantially extend in a first direction and at least one of the segments substantially extends in a second direction that is substantially orthogonal to the first direction, and where each one of the two or more of the segments that substantially extend in the first direction is respectively associated with and located proximate a corresponding one of the first and second feed points, and one of the at least one of the segments that substantially extends in a second direction includes or is proximate the location along the loop that is substantially equidistant from the first and second feed points.

20. The radiotelephone of claim 19, wherein the transmitter is coupled to at least one of the sum or difference input ports of the hybrid coupler.

21. The radiotelephone of claim 19, wherein the receiver is coupled to at least the one of the sum or difference input having a largest signal strength.

22. The radiotelephone of claim 19, wherein a receiver input is connected to each of the sum and difference inputs, and a receiver signal output corresponding to a largest signal strength is selected.

23. A diversity antenna, comprising:

a loop antenna disposed with two feed points proximal to a counterpoise;

means for feeding the loop antenna in a sum mode and in a difference mode;

means for resonating the loop antenna and impedance matching the loop antenna with respect to the sum mode feed means;

means for resonating the loop antenna in the difference mode; and means for impedance matching the loop antenna with respect to the difference mode feed means; and wherein the means for resonating the loop antenna and impedance matching the loop antenna with respect to the sum mode feed means allows for an adjustment of the impedance of the loop antenna with respect to the sum mode feed means in a manner that has a substantially negligible impact on the impedance matching of the loop antenna with respect to the difference mode feed means.

* * * * *